US008965229B2

(12) United States Patent
Iwasaki et al.

(10) Patent No.: US 8,965,229 B2
(45) Date of Patent: Feb. 24, 2015

(54) FIXING DEVICE, IMAGE FORMING APPARATUS, AND NON-TRANSITORY COMPUTER READABLE MEDIUM

(75) Inventors: Takeo Iwasaki, Kanagawa (JP); Hajime Kishimoto, Kanagawa (JP); Motofumi Baba, Kanagawa (JP); Shuichi Suzuki, Kanagawa (JP); Tsuyoshi Sunohara, Kanagawa (JP); Shinichi Kinoshita, Kanagawa (JP); Takashi Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 150 days.

(21) Appl. No.: 13/560,462

(22) Filed: Jul. 27, 2012

(65) Prior Publication Data

US 2013/0195489 A1 Aug. 1, 2013

(30) Foreign Application Priority Data

Jan. 26, 2012 (JP) ..... 2012-014516

(51) Int. Cl.
*G03G 15/20* (2006.01)
*G03G 15/00* (2006.01)

(52) U.S. Cl.
CPC ..... *G03G 15/657* (2013.01); *G03G 15/2078* (2013.01)
USPC ..... 399/67; 399/68

(58) Field of Classification Search
CPC ..... G03G 15/657; G03G 15/2078; G03G 15/5004; G03G 2215/00413; G03G 2215/00599; G03G 2215/00721
USPC ..... 399/67, 68
See application file for complete search history.

(56) References Cited

U.S. PATENT DOCUMENTS

| | | | | |
|---|---|---|---|---|
| 6,181,890 | B1 * | 1/2001 | Kataoka et al. | 399/67 |
| 7,212,759 | B2 * | 5/2007 | Kishi et al. | 399/69 |
| 8,331,819 | B2 * | 12/2012 | Fukuzawa et al. | 399/69 |
| 2010/0003043 | A1 * | 1/2010 | Miyagawa | 399/69 |

FOREIGN PATENT DOCUMENTS

JP 2003-307964 A 10/2003

* cited by examiner

*Primary Examiner* — Ryan Walsh
(74) *Attorney, Agent, or Firm* — Sughrue Mion, PLLC

(57) ABSTRACT

A fixing device includes a fixing unit, a power supply unit, a pressure applying unit, and a controller. The fixing unit fixes toner onto a recording medium, using heat generated by a heat generator. The power supply unit supplies power to drive the fixing unit. The pressure applying unit applies pressure to the recording medium in a nip part between the pressure applying unit and the fixing unit. When plural recording media are sequentially transported, the controller controls the power supply unit to supply power during a first time period from when a trailing edge of one of the recording media passes the nip part to when a leading edge of the subsequent recording medium arrives at the nip part, in accordance with a relationship between the first time period and a second time period required to start the supply of power after the supply of power is stopped.

18 Claims, 11 Drawing Sheets

FIXING DEVICE, IMAGE FORMING APPARATUS, AND NON-TRANSITORY COMPUTER READABLE MEDIUM

CROSS-REFERENCE TO RELATED APPLICATIONS

This application is based on and claims priority under 35 USC 119 from Japanese Patent Application No. 2012-014516 filed Jan. 26, 2012.

BACKGROUND (i) Technical Field

The present invention relates to a fixing device, an image forming apparatus, and a non-transitory computer readable medium.

(ii) Related Art

In image forming apparatuses, fixing devices consume a large amount of power to emit thermal energy. Techniques for reducing wasteful emission of thermal energy are available.

SUMMARY

According to an aspect of the invention, there is provided a fixing device including a fixing unit, a power supply unit, a pressure applying unit, and a controller. The fixing unit fixes toner onto a recording medium transported in a determined transport direction, using heat generated by a heat generator. The power supply unit supplies power to drive the fixing unit. The pressure applying unit applies pressure to the recording medium in a nip part formed between the pressure applying unit and the fixing unit. When plural recording media are sequentially transported, the controller controls the power supply unit to supply power during a first time period in accordance with a relationship between the first time period and a second time period. The first time period is a time period from when a trailing edge of one of the recording media in the transport direction passes the nip part to when a leading edge of a recording medium subsequent to the one of the recording media in the transport direction arrives at the nip part. The second time period is a time period required for the power supply unit to start the supply of power after the power supply unit stops the supply of power.

BRIEF DESCRIPTION OF THE DRAWINGS

Exemplary embodiments of the present invention will be described in detail based on the following figures, wherein.

DETAILED DESCRIPTION

Figure 1:
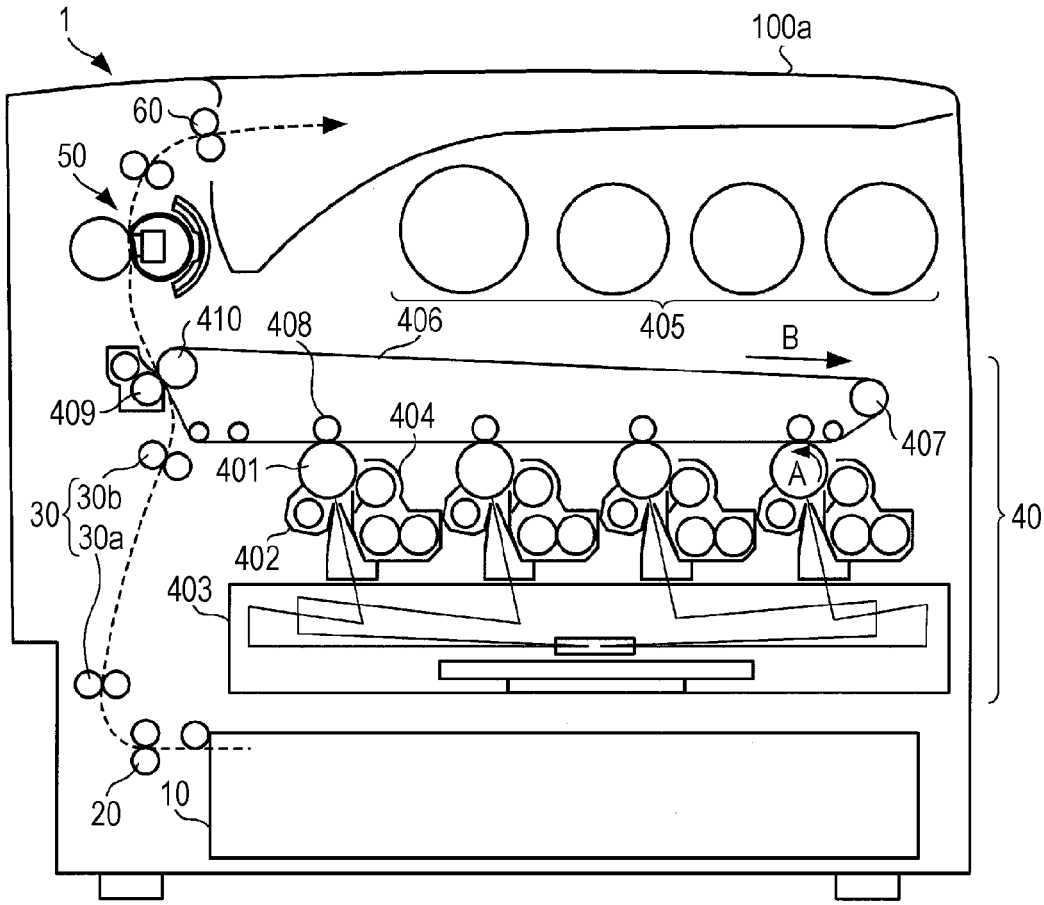
FIG. 1 schematically illustrates the internal configuration of an image forming apparatus.

FIG. 1 schematically illustrates an internal configuration of an image forming apparatus 1 according to an exemplary embodiment of the present invention. The image forming apparatus 1 may be an apparatus having functions of a copying machine, a printer, a scanner, a facsimile machine, and so forth. The image forming apparatus 1 has a housing 100*a* including a sheet accommodating section 10, supply rollers 20, transport rollers 30 including transport rollers 30*a* and 30*b*, a transfer section 40, a fixing section 50, and ejection rollers 60. The sheet accommodating section 10 accommodates sheets of paper p, which are examples of a recording medium. The supply rollers 20 are brought into contact with each sheet of paper p accommodated in the sheet accommodating section 10, and supply the sheet of paper p along a transport path (indicated by a dash line). Each of the transport rollers 30*a* and 30*b* is a cylindrical member, and rotates about its center axis to supply the sheet of paper p supplied by the rollers 20. The sheet of paper p is transported by the transport rollers 30, and passes through the transfer section 40. The transport rollers 30 transport the sheet of paper p at the timing when the transfer section 40 transfers a toner image. The transfer section 40 transfers a toner image onto the sheet of paper p transported by the transport rollers 30. The fixing section 50, which is an example of a fixing device, heats the toner image transferred by the transfer section 40 to fix the toner image onto the sheet of paper p. The ejection rollers 60 eject the sheet of paper p onto which the toner image has been fixed from the image forming apparatus 1.

The transfer section 40 includes photoconductor drums 401, chargers 402, an exposure device 403, developing devices 404, toner cartridges 405, an intermediate transfer belt 406, a rotating roller 407, first transfer rollers 408, a second transfer roller 409, and a backup roller 410. Each of the photoconductor drums 401 is a cylindrical member having a photoconductive film formed on its outer peripheral surface, and is supported so as to rotate about its center axis. The photoconductor drums 401 are disposed so as to be in contact with the intermediate transfer belt 406, and rotate in a direction indicated by an arrow A in FIG. 1 about their center axes in accordance with the movement of the intermediate transfer belt 406. Each of the chargers 402 may be, for example, a scorotron charger, and is configured to charge the photoconductive film of the corresponding photoconductor drum 401 to a predetermined potential. The exposure device 403 exposes each of the photoconductor drums 401 charged by the chargers 402 to light to form an electrostatic latent image. Each of the developing devices 404 accommodates a two-component developer containing toner of one of yellow (Y), magenta (M), cyan (C), and black (K) and magnetic carrier such as a ferrite powder. Each of the developing devices 404 adheres toner onto the electrostatic latent image formed on the corresponding one of the photoconductor drums 401 to form a toner image. The developing devices 404 are connected to the toner cartridges 405 via toner supply paths, and are replenished with toner from the toner cartridges 405 by rotational driving of a dispenser motor (not illustrated). The intermediate transfer belt 406 may be an endless belt-shaped member, and rotates in a direction indicated by an arrow B in FIG. 1. The rotating roller 407 is a cylindrical member that supports the movement of the intermediate transfer belt 406, and rotates about its center axis. The first transfer rollers 408 are cylindrical members facing the photoconductor drums 401 with the intermediate transfer belt 406 disposed therebetween. A transfer bias is applied to each of the first transfer rollers 408 from a power supply (not illustrated) to produce a potential difference between the first transfer roller 408 and the corresponding one of the photoconductor drums 401, and the toner image on the surface of the photoconductor drum 401 is transferred onto the surface of the intermediate transfer belt 406. The second transfer roller 409 is a cylindrical member facing the backup roller 410 with the intermediate transfer belt 406 disposed therebetween. A transfer bias is applied to the second transfer roller 409 from the power supply (not illustrated) to produce a potential difference between the second transfer roller 409 and the backup roller 410, and the toner image on the surface of the intermediate transfer belt 406 is transferred onto the sheet of paper p.

The image forming apparatus 1 further includes a controller, a communication section, a memory, and a power supply section, which are not illustrated in FIG. 1. The controller controls the operations of the individual components of the image forming apparatus 1 described above. The controller includes a central processing unit (CPU), a read only memory (ROM), and a random access memory (RAM). The communication section is connected to an external device such as a personal computer or a facsimile machine, and transmits and receives image data to and from the external device. The memory includes a device that stores data and programs to be used by the controller, for example, a hard disk drive (HDD). The power supply section supplies power necessary to operate each of the components of the image forming apparatus 1. With the above configuration, the image forming apparatus 1 forms and fixes a toner image onto each sheet of paper p while transporting the sheet of paper p along the transport path. Hereinafter, the direction in which each sheet of paper p is transported is referred to simply as the "transport direction", and the direction perpendicular to the transport direction as the "widthwise direction".

Figure 2:
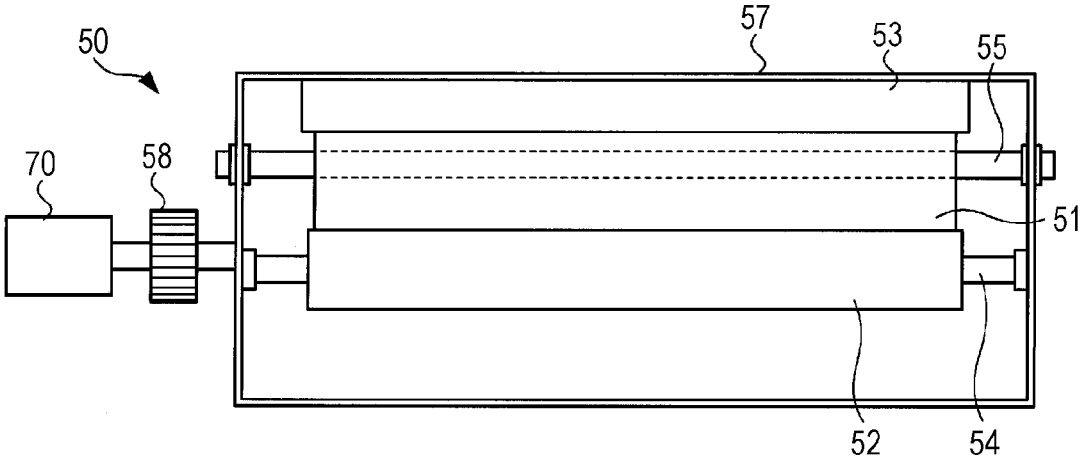
FIG. 2 is a cross-sectional view of a fixing section, when viewed from the upstream side in the transport direction.
Figure 3:
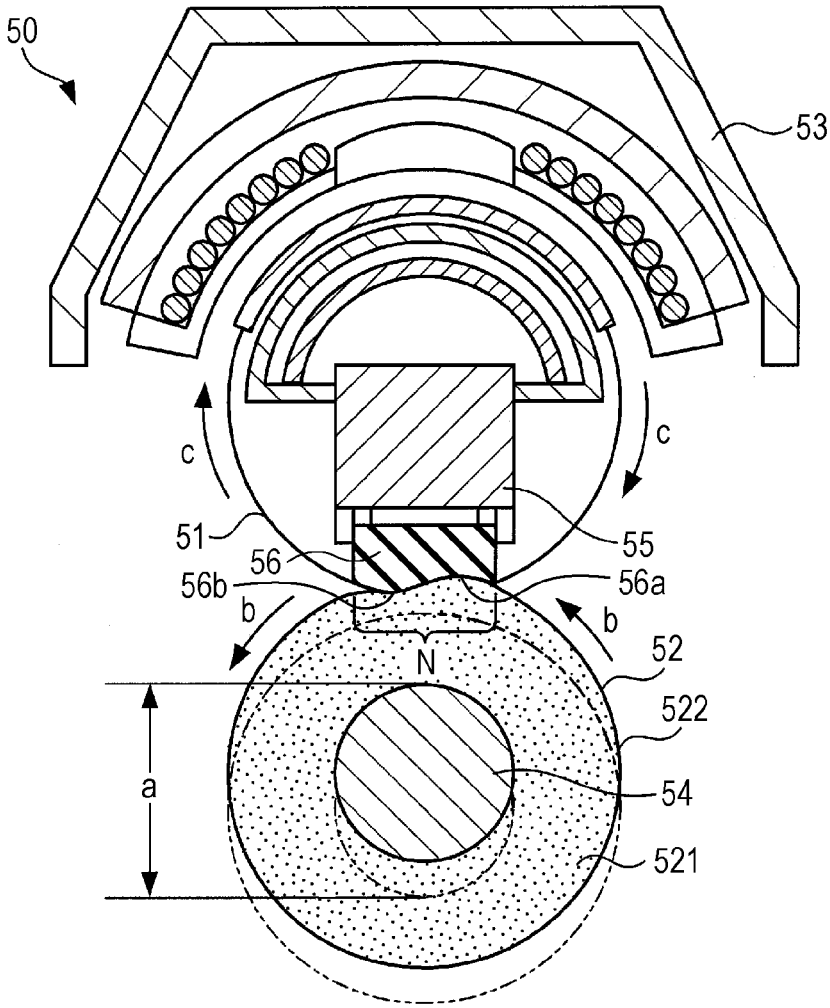
FIG. 3 is a cross-sectional view of the fixing section, when viewed from either side in the widthwise direction.

FIGS. 2 and 3 are cross-sectional views illustrating the internal configuration of the fixing section 50 according to an exemplary embodiment of the present invention. FIG. 2 is a view of the fixing section 50, when viewed from the upstream side in the transport direction of the sheets of paper p, and FIG. 3 is a view of the fixing section 50, when viewed from either side in the widthwise direction of the sheets of paper p. As illustrated in FIGS. 2 and 3, the fixing section 50 has a support member 57 including a fixing belt 51, which is an example of a fixing unit, a pressure roller 52, which is an example of a pressure applying unit, and an induction heating (IH) heater 53, which is an example of a magnetic field generation unit.

Figure 4:
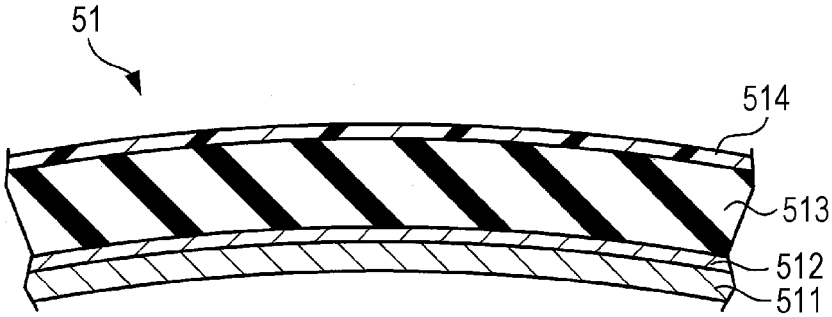
FIG. 4 is a cross-sectional view of a fixing belt.

FIG. 4 is a cross-sectional view of the fixing belt 51. The fixing belt 51 may be an endless belt member originally having a cylindrical shape, and may have, for example, a diameter of 30 mm and a length in the widthwise direction of 380 mm. The fixing belt 51 has a multi-layer structure including a base layer 511, a conductive heat generating layer 512, an elastic layer 513, and a surface release layer 514. The base layer 511 supports the conductive heat generating layer 512, which is a thin layer, and is formed of a heat-resistant sheet-shaped member that achieves the mechanical strength of the overall fixing belt 51. The base layer 511 is further formed of such a material and has such a thickness that properties are achieved which allow a magnetic field to pass therethrough (relative permeability, specific resistance). That is, the base layer 511 does not, or is unlikely to, generate heat upon being acted upon by a magnetic field. Specifically, the base layer 511 is formed of, for example, a nonmagnetic metal material such as nonmagnetic stainless steel having a thickness of 30 μm or more and 200 μm or less, a resin material having a thickness of 60 μm or more and 200 μm or less, or any other suitable material. The conductive heat generating layer 512, which is an example of a heat generator, is a layer which is heated through electromagnetic induction by an alternating magnetic field generated by the IH heater 53. The conductive heat generating layer 512 is a layer through which an alternating magnetic field passes in the thickness direction and in which as a result eddy currents flow. An alternating magnetic field having a frequency of 20 kHz or more and 100 kHz or less may be used. The conductive heat generating layer 512 has a characteristic such that an alternating magnetic field with a frequency of 20 kHz or more and 100 kHz or less enters and passes therethrough. Examples of the material of the conductive heat generating layer 512 may include elemental metals such as Au, Ag, Al, Cu, Zn, Sn, Pb, Bi, Be, and Sb, and an alloy thereof. Specifically, the conductive heat generating layer 512 may be formed of a nonmagnetic metal (paramagnetic material having a relative permeability of approximately 1), such as Cu, having a thickness of 2 μm or more and 20 μm or less and a specific resistance of 2.7×10-8 Ω·m or less. In order to reduce the time period (hereinafter referred to as the "warm-up time") required for the fixing belt 51 to be heated up to the temperature necessary to fix the toner to each sheet of paper p (hereinafter referred to as the "fixing temperature"), the conductive heat generating layer 512 is formed thin to reduce the thermal capacity. The elastic layer 513 is formed of a heat-resistant elastic body of silicone rubber or the like. The elastic layer 513 deforms in accordance with the irregularities of the toner image transferred onto the sheet of paper p to uniformly supply heat to the toner image. For example, the elastic layer 513 may be formed of silicone rubber having a thickness of 100 μm or more and 600 μm or less and a hardness of 10° or more and 30° or less (JIS-A). Since the surface release layer 514 is brought into direct contact with an unfixed toner image that is held on a sheet of paper p, the surface release layer 514 may be formed of a material having high toner releasability. Examples of the material of the surface release layer 514 may include tetrafluoroethylene-perfluoroalkyl vinyl ether copolymer (PFA), polytetrafluoroethylene (PTFE), silicone copolymer, and a composite layer thereof. If the surface release layer 514 is too thin, the surface release layer 514 may become insufficient in terms of abrasion resistance, and the life of the fixing belt 51 may become short. If the surface release layer 514 is too thick, on the other hand, the thermal capacity of the fixing belt 51 may become too large, and the time required to reach the fixing temperature may become long. Accordingly, in terms of the balance between abrasion resistance and thermal capacity, the thickness of the surface release layer 514 may be set to, for example, 1 μm or more and 50 μm or less.

Referring back to FIG. 3, the fixing belt 51 fixes the toner onto the sheet of paper p transported in the determined transport direction by means of the heat generated from the conductive heat generating layer 512. The pressure roller 52 presses the sheet of paper p in a nip part N formed between the pressure roller 52 and the fixing belt 51. The pressure roller 52 is disposed so as to face the fixing belt 51. The IH heater 53 generates an alternating magnetic field for causing the conductive heat generating layer 512 of the fixing belt 51 to generate heat through electromagnetic induction. The fixing belt 51 includes a pressing pad 56 inside its cylindrical shape.

The pressing pad 56 may be formed of an elastic body of silicone rubber, fluororubber, or the like, and is supported by a holder 55 at the position facing the pressure roller 52. The pressing pad 56 is arranged so as to be pressed by the pressure roller 52 through the fixing belt 51, and forms the nip part N between the pressing pad 56 and the pressure roller 52. Further, the pressing pad 56 has a pre-nip area 56*a* on the entrance side of the nip part N (or on the upstream side in the transport direction of the sheets of paper p) and a post-nip area or release nip area 56*b* on the exit side of the nip part N (or on the downstream side in the transport direction of the sheets of paper p). The pre-nip area 56*a* and the release nip area 56*b* are set to different nip pressures. The pre-nip area 56*a* is formed so as to have an arc shape which follows the outer peripheral surface of the pressure roller 52. The release nip area 56*b* is formed so as to be pressed with a locally high nip pressure from the surface of the pressure roller 52 so that the radius of curvature of the fixing belt 51 is reduced as the fixing belt 51 passes the release nip area 56*b*. The release nip area 56*b* allows the sheet of paper p that passes through the nip part N to be curled (down-curled) in a direction apart from the surface of the fixing belt 51 to facilitate the release of the sheet of paper p from the surface of the fixing belt 51.

In addition, as illustrated in FIG. 2, in the fixing belt 51, both ends of the holder 55 in the widthwise direction are supported by the support member 57 so that the holder 55 rotates. When the fixing belt 51 and the pressure roller 52 are brought into contact with each other by a driving mechanism (not illustrated), the pressure roller 52 presses the fixing belt 51 across the entire width. Due to the frictional force between the fixing belt 51 and the pressure roller 52, the fixing belt 51 rotates so as to follow the pressure roller 52. When the pressure roller 52 is spaced away from the fixing belt 51 by the driving mechanism, the driving force fails and the fixing belt 51 stop its rotation.

Referring back to FIG. 3, the pressure roller 52 is a cylindrical member including an elastic layer 521 and a release layer 522. The elastic layer 521 may be heat-resistant and elastic, and may be formed of, for example, foamed silicone rubber or the like. The release layer 522 is a layer which is brought into contact with the sheets of paper p, and may be formed of a material having high releasability from the sheets of paper p. The release layer 522 is, for example, a heat-resistant resin coating or a heat-resistant rubber coating such as a carbon-containing PFA coating. The release layer 522 may have a thickness of, for example, 50 μm. The pressure roller 52 may have, for example, a diameter of 28 mm and a length in the widthwise direction of 390 mm. The pressure roller 52 is arranged so as to extend along the holder 55 of the fixing belt 51, and moves in a direction indicated by an arrow a with respect to the fixing belt 51 by using the driving mechanism (not illustrated) to be in contact with or away from the fixing belt 51.

As illustrated in FIG. 2, the pressure roller 52 has a rotating shaft 54 extending therethrough at the center of rotation thereof. Both ends of the rotating shaft 54 are supported by the support member 57 so that the rotating shaft 54 rotates. Both ends of the rotating shaft 54 are further supported so that the rotating shaft 54 may move within a predetermined range in the direction in which the fixing belt 51 is supported. A gear 58 is fixed to one end of the rotating shaft 54, and transmits a driving force from a driving motor 70 to the rotating shaft 54. Upon receiving a driving force, the pressure roller 52 rotates in a direction indicated by an arrow b in FIG. 3. In accordance with the rotation of the pressure roller 52, the fixing belt 51 also rotates in a direction indicated by an arrow c. When the fixing belt 51 and the pressure roller 52 rotate, the pressure roller 52 presses the fixing belt 51, and forms the nip part N at the position where the pressure roller 52 is in contact with the fixing belt 51. When the sheet of paper p onto which a toner image has been transferred passes the nip part N, the toner image is fixed onto the sheet of paper p by heat and pressure.

Figure 5:
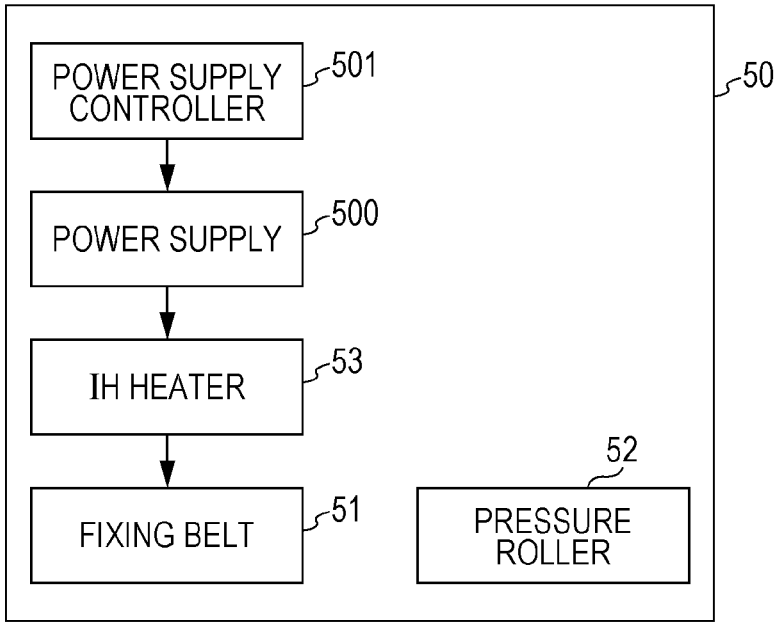
FIG. 5 is a block diagram illustrating the configuration of the fixing section.

FIG. 5 is a block diagram illustrating the configuration of the fixing section 50. The fixing section 50 includes a power supply 500, which is an example of a power supply unit, and a power supply controller 501, which is an example of a controller, in addition to the fixing belt 51, the pressure roller 52, and the IH heater 53. The power supply 500 supplies power to drive the fixing belt 51. The power supply controller 501 is a computer including a CPU, a ROM, and a RAM, and configured to control the supply of power from the power supply 500. When plural sheets of paper p are sequentially transported from the transport rollers 30, the power supply controller 501 controls the supply of power based on the relationship between a first time period (hereinafter referred to as Tgap) and a second time period (hereinafter referred to as Tup). Tgap is a time period from when the trailing edge of a given sheet of paper p in the transport direction passes the nip part N to when the leading edge of the subsequent sheet of paper p in the transport direction arrives at the nip part N. Tup is a time period required for the power supply 500 to start (i.e., to turn on) the supply of power after the supply of power is stopped. The term "trailing edge" or "leading edge" of a sheet of paper p, as used herein, refers to a side of the sheet of paper p on its trailing edge side or a side of the sheet of paper p on its leading edge side. As used herein, the phrase "the supply of power is started" is used when the magnitude of the power to be supplied from the power supply 500 exceeds a threshold at which the toner is fixed onto each sheet of paper p.

Figure 6:
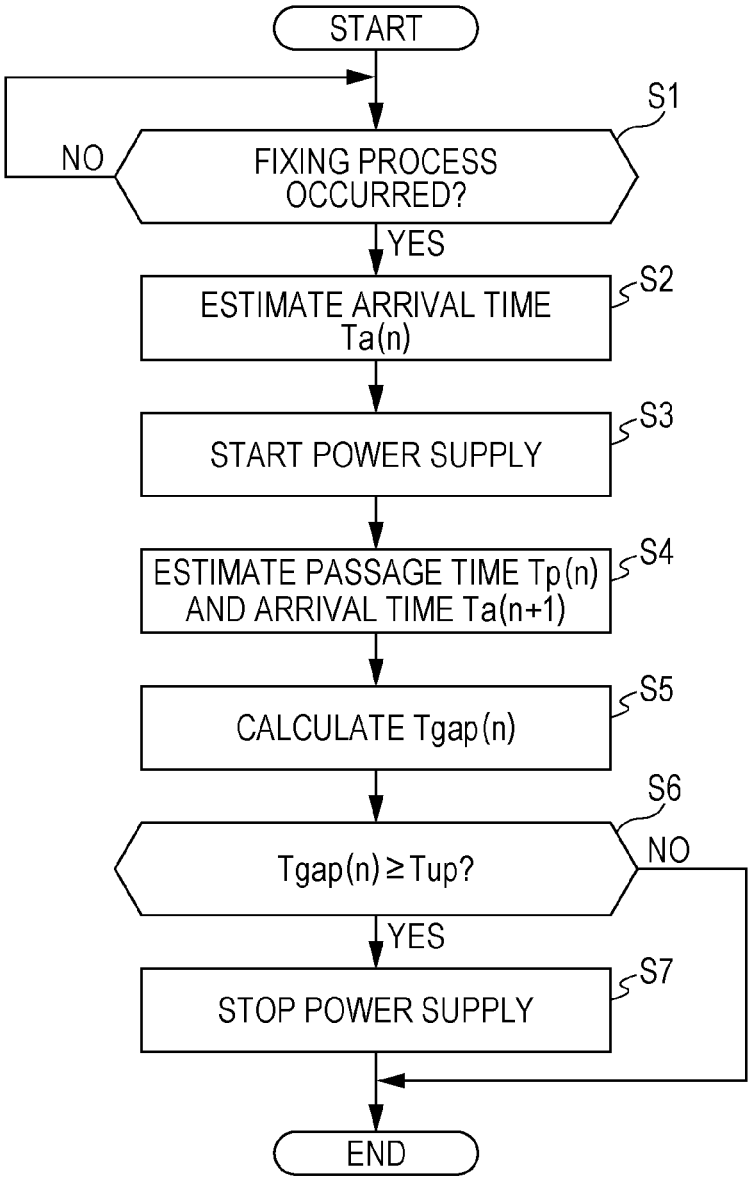
FIG. 6 is a flowchart illustrating the operation of the fixing section.

FIG. 6 is a flowchart illustrating the operation of the fixing section 50 according to an exemplary embodiment of the present invention. Before the process illustrated in FIG. 6 starts, the power supply controller 501 stores time Tup in the ROM. In the following description, the time at which the side of each sheet of paper p on its leading edge side in the transport direction arrives at the entrance of the nip part N is referred to as the "arrival time". In addition, the time at which the side of each sheet of paper p on its trailing edge in the transport direction passes the exit of the nip part N is referred to as the "passage time".

In step S1, the power supply controller 501 determines whether or not a process of fixing the toner onto one of the sheets of paper p (hereinafter referred to as the "fixing process") has occurred. In this exemplary embodiment, by way of example, plural fixing processes occur. In the following description, a given fixing process among the plural fixing processes is referred to as the "n-th fixing process", and the fixing process subsequent to the n-th fixing process is referred to as the "(n+1)-th fixing process". In addition, the sheets of paper p onto which the toner is fixed in the n-th fixing process and the (n+1)-th fixing process are referred to as the "n-th sheet of paper p" and the "(n+1)-th sheet of paper p", respectively. The occurrence of the fixing process is indicated by a signal output from the CPU of the image forming apparatus 1. If it is determined that the fixing process has occurred (YES in step S1), the power supply controller 501 causes the process to proceed to step S2. If it is determined that the fixing process has not occurred (NO in step S1), the power supply controller 501 causes the process to wait until the fixing process has occurred.

In step S2, the power supply controller 501 estimates the arrival time Ta(n) of the n-th sheet of paper p. The power supply controller 501 acquires from a position sensor (not illustrated) a time Tb(n) at which the n-th sheet of paper p reached a certain point on the transport path. The position sensor may be included in, for example, the transport roller 30*a*, and measures the time Tb at which each sheet of paper p arrives at the transport roller 30*a*. The position sensor also measures a rotational speed Vb(n) at which the transport roller 30*a* rotates when measuring the time Tb. The rotational speed V is a speed at which each sheet of paper p is transported. The power supply controller 501 estimates the arrival time Ta(n) in accordance with the time Tb(n) and the rotational speed Vb(n) using a predetermined formula.

In step S3, the power supply controller 501 causes the power supply 500 to start the operation of turning on the supply of power. The power supply controller 501 starts an operation so that the supply of power is turned on at the arrival time Ta(n). Specifically, the power supply controller 501 controls the power supply 500 to start the operation of turning on the supply of power at a time which is Tup prior to the arrival time Ta(n).

In step S4, the power supply controller 501 estimates the passage time Tp(n) of the n-th sheet of paper p and the arrival time Ta(n+1) of the (n+1)-th sheet of paper p. The power supply controller 501 acquires from the position sensor a time Tq(n) and a rotational speed Vq(n) at which the trailing edge of the n-th sheet of paper p in the transport direction passed the transport roller 30*b*, and a time Tb(n+1) and a rotational speed Vb(n+1) at which the leading edge of the (n+1)-th sheet of paper p in the transport direction arrived at the transport roller 30*b*. The power supply controller 501 estimates the passage time Tp(n) in accordance with the time Tq(n) and the rotational speed Vq(n) using the predetermined formula. The power supply controller 501 further estimates the arrival time Ta(n+1) in accordance with the time Tb(n+1) and the rotational speed Vb(n+1) using the predetermined formula. The power supply controller 501 stores the estimated passage time Tp(n) and arrival time Ta(n+1) in the RAM.

In step S5, the power supply controller 501 calculates a time Tgap(n). The power supply controller 501 reads the passage time Tp(n) and arrival time Ta(n+1) estimated in step S4 from the RAM, and calculates the time Tgap(n) using the following formula (1).

$$Tgap(n)=Ta(n+1)-Tp(n) \quad (1)$$

In formula (1), n denotes the number of the sheet of paper p (n=1, 2, 3 . . . ). The time Tgap of the n-th sheet of paper p represents a time period from when the trailing edge of the n-th sheet of paper p in the transport direction passes the exit of the nip part N to when the leading edge of the (n+1)-th sheet of paper p in the transport direction arrives at the entrance of the nip part N. The power supply controller 501 stores the calculated time Tgap(n) in the RAM.

In step S6, the power supply controller 501 determines whether or not the time Tgap(n) is longer than or equal to the time Tup. The power supply controller 501 reads the times Tgap(n) and Tup, and compares the length of the times Tgap (n) and Tup. If the time Tgap(n) is longer than or equal to the time Tup (YES in step S6), the power supply controller 501 causes the process to proceed to step S7. If the time Tgap(n) is shorter than the time Tup (NO in step S6), the power supply controller 501 terminates the process, and performs the subsequent fixing process.

In step S7, the power supply controller 501 causes the power supply 500 to stop the supply of power. In this exemplary embodiment, by way of example, the time period (hereinafter referred to as Tdown) required for the power supply 500 to stop (or turn off) the supply of power after the supply of power is turned on is shorter than the time Tup, and may be approximated to zero. In this case, the power supply controller 501 turns off the supply of power at the passage time Tp(n).

If the remaining number of times the fixing process is to be performed is one, the power supply controller 501 controls the power supply 500 to turn on the supply of power at the arrival time Ta(n). Further, the power supply controller 501 causes the supply of power to be turned off at the passage time Tp(n). In this case, the estimation of the arrival time Ta(n+1) in step S4 and the processing of steps S5 and S6 are not performed.

Figure 7:
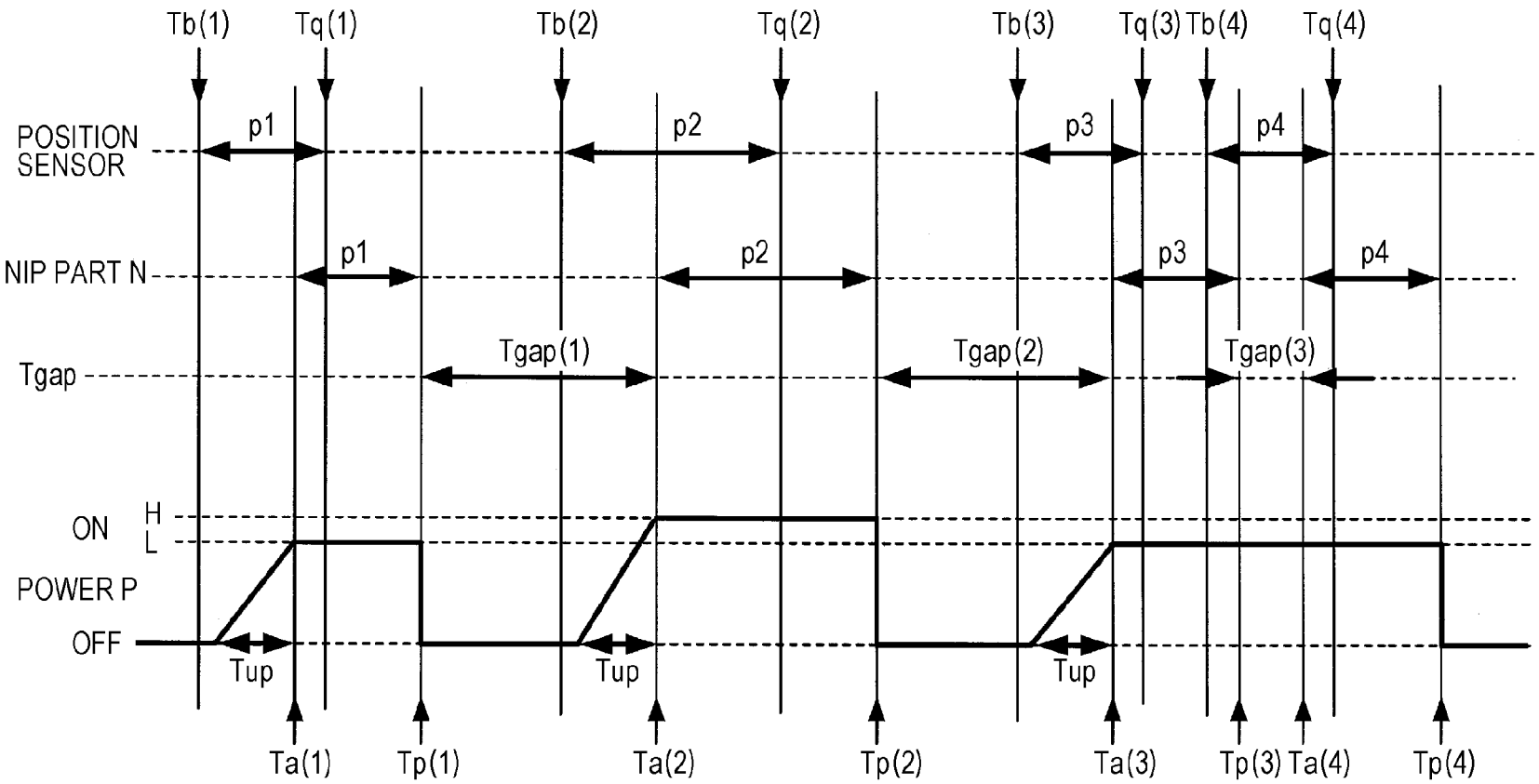
FIG. 7 is a timing chart illustrating the relationship between power and the time during which each sheet of paper passes a nip part.

FIG. 7 is a timing chart illustrating the relationship between the time during which each sheet of paper p passes the nip part N in the fixing process and the power supplied from the power supply 500. In FIG. 7, four fixing processes are performed. Arrows in the "position sensor" part represent time periods during which four sheets of paper p (p1 to p4) pass the transport roller 30*b*. Each sheet of paper p arrives at the transport roller 30*b* at time Tb, and passes the transport roller 30*b* at time Tq. Arrows in the "nip part N" part represent times at which the four sheets of paper p pass the nip part N. The arrival time Ta and the passage time Tp of each sheet of paper p are estimated in accordance with the time Tb and the rotational speed Vb corresponding to the sheet of paper p and the time Tq and the rotational speed Vq corresponding to the sheet of paper p. In FIG. 7, for example, the estimated arrival time and passage time of the sheet of paper p1 that arrived at the transport roller 30*b* at time Tb(1) and that passed the transport roller 30*b* at time Tq(1) are Ta(1) and Tp(1), respectively.

In FIG. 7, Tgap represents a time period from the passage time Tp(n) to the arrival time Ta(n+1). For example, Tgap(1) represents a time period from the passage time Tp(1) to the arrival time Ta(2). In the example illustrated in FIG. 7, four fixing processes are performed, and therefore three times Tgap are obtained. The length of Tgap differs depending on the paper type. For example, if plain paper (64 g/m$^2$ or more and less than 98 g/m$^2$) and thick paper (98 g/m$^2$or more and less than 169 g/m$^2$) are used as paper types, the controller of the image forming apparatus 1 performs control so that the time period during which the thick paper passes the nip part N is longer than the time period during which the plain paper passes the nip part N. Thus, the time period Tgap obtained when a certain sheet of paper p (e.g., the n-th sheet of paper p) or the subsequent sheet of paper p (e.g., the (n+1)-th sheet of paper p) is thick paper is longer than the time period Tgap obtained when the certain sheet of paper p and the subsequent sheet of paper p are plain paper. In FIG. 7, by way of example, the sheets of paper p1, p3, and p4 are plain paper, and the sheet of paper p2 is thick paper. In this case, each of the time periods Tgap(1) and Tgap(2) is longer than the time period Tgap(3).

The power P represents the magnitude of the power supplied from the power supply 500. The power supplied from the power supply 500 is switched between "on" and "off". The magnitude of the power supplied when the supply of power is turned on is set different depending on the paper type. Specifically, the magnitude of the power supplied when thick paper passes the nip part N is set larger than the magnitude of the power supplied when plain paper passes the nip part N. The power supply controller 501 acquires information indicating the paper type from the CPU of the image forming apparatus 1, and adjusts the magnitude of the power to be supplied from the power supply 500 in accordance with the paper type. In FIG. 7, mode L represents a power mode in which plain paper passes the nip part N, and mode H represents a power mode in which thick paper passes the nip part N. Tup represents a time period required for the power supply 500 to set the mode L or the mode H after the supply of power is turned off. Here, it is assumed that a time period required for the mode L to be set after the supply of power is turned off and a time period required for the mode H to be set after the supply of power is turned off are equal to each other.

In the first fixing process, the power supply controller 501 controls the power supply 500 to start the operation of turning on the supply of power at a time which is Tup prior to the arrival time Ta(1). Since the sheet of paper p1 is plain paper, the power supply controller 501 sets the power supply 500 to the mode L. At the arrival time Ta(1), the power mode is switched to the mode L. This exemplary embodiment is based on the ideal state where the thermal capacity of the fixing belt 51 is zero and where the warm-up time is zero. Since Tgap(1)≥Tup (YES in step S6), the power supply controller 501 turns off the supply of power at the passage time Tp(1).

In the second fixing process, the power supply controller 501 controls the power supply 500 to start the operation of turning on the supply of power at a time which is Tup prior to the arrival time Ta(2). Since the sheet of paper p2 is thick paper, the power supply controller 501 sets the power supply 500 to the mode H. At the arrival time Ta(2), the power mode is switched to the mode H. Since Tgap(2)≥Tup (YES in step S6), the power supply controller 501 turns off the supply of power at the passage time Tp(2).

In the third fixing process, since the sheet of paper p3 is plain paper, the power supply controller 501 sets the power supply 500 to the mode L. At the arrival time Ta(3), the power mode is switched to the mode L. Since Tgap(3)<Tup (NO in step S6), the power supply controller 501 continues the supply of power in the mode L.

In the fourth fixing process, since the sheet of paper p4 is plain paper, the power supply controller 501 sets the power supply 500 to the mode L. Since the power supply 500 is in the mode L when the third fixing process is completed, the power supply controller 501 maintains the power mode at the mode L. Since the remaining number of fixing processes is one, the power supply controller 501 turns off the supply of power at the passage time Tp(4). Accordingly, if Tgap is longer than or equal to Tup, the supply of power from the power supply 500 is temporarily turned off. Thus, the amount of power consumed by the fixing section 50 may be reduced, compared to when power is continuously supplied during fixing processes.

Modifications

The present invention is not limited to the foregoing exemplary embodiment, and a variety of modifications may be made. Some modifications will be described. Two or more of the following modifications may be used in combination.

First Modification

In the foregoing exemplary embodiment, it is assumed that Tdown is shorter than Tup and may be approximated to zero. Tdown may not necessarily be approximated to zero. In this case, in step S6 illustrated in FIG. 6, the power supply controller 501 may determine whether or not Tgap(n) is longer than or equal to the sum of Tup and Tdown (Tgap(n)≥Tup+Tdown). In this case, before the process illustrated in FIG. 6 starts, the power supply controller 501 stores Tup and Tdown in the ROM.

Figure 8:
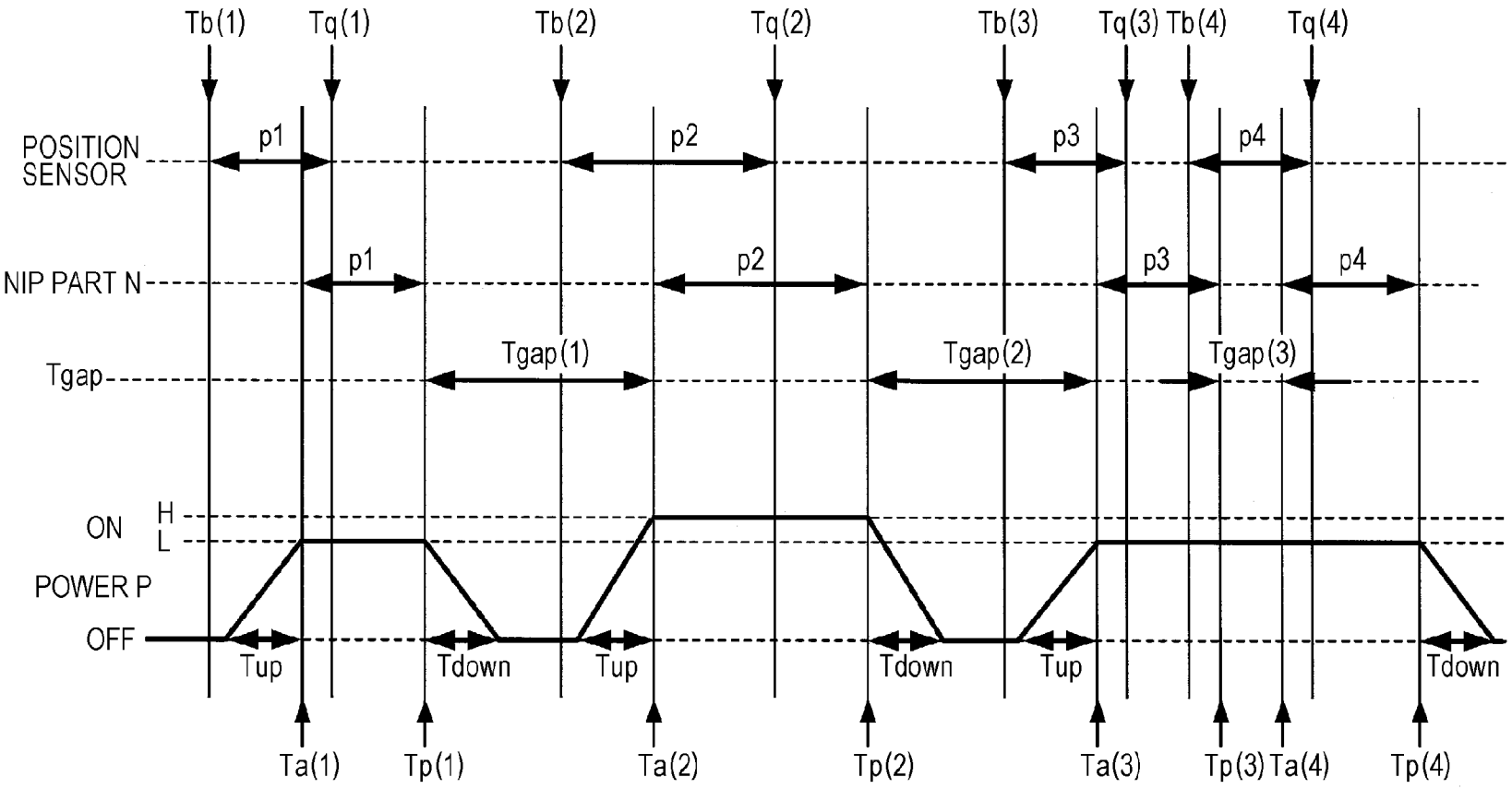
FIG. 8 is a timing chart of a fixing process according to a first modification.

FIG. 8 is a timing chart of a fixing process according to a first modification. In FIG. 8, Tdown represents a time period required for the power supply 500 to turn off the supply of power after the mode L or the mode H is set. Here, it is assumed that a time period required for the supply of power to be turned off after the mode L is set and a time period required for the supply of power to be turned off after the mode H is set are equal to each other. The operation of the fixing section 50 according to the first modification will be described, focusing on the difference from the exemplary embodiment.

In the first fixing process, since Tgap(1)≥Tup+Tdown (YES in step S6), the power supply controller 501 controls the power supply 500 to start the operation of turning off the supply of power at the passage time Tp(1). The supply of power is turned off at a time which is Tdown after the passage time Tp(1). Also in the second fixing process, Tgap(2)≥Tup+Tdown (YES in step S6). Thus, the power supply controller 501 performs a process similar to the first fixing process. In the third fixing process, since Tgap(3)<Tup+Tdown (NO in step S6), the power supply controller 501 maintains the power mode at the mode L. The first modification is different from the exemplary embodiment in that the supply of power is continued even if Tgap is longer than or equal to Tup.

Second Modification

The determination of whether or not to temporarily turn off the supply of power from the power supply 500 during the fixing process may not necessarily be based on the length of Tgap. For example, a process for maintaining or managing the image forming apparatus 1 (hereinafter referred to as the "setup process") may be performed, and if Tgap is made longer by the length of the time period (hereinafter referred to as Tsetup) required for the setup process, it may be determined whether or not to temporarily turn off the supply of power in accordance with Tsetup. Examples of the setup process may include the a potential setup process for adjusting the potential of each of the photoconductor drums 401, a density setup process for correcting the density or gradation of a toner image to be formed on each of the photoconductor drums 401, and a non-uniformity correction setup process for correcting non-uniformity in the toner image to be formed on each of the photoconductor drums 401. The above setup processes are merely examples, and may include a process to be performed on a portion other than the photoconductor drums 401. No sheets of paper p pass the nip part N for a time period during which the setup process is being performed. Tsetup is determined in advance for each type of setup process. In a second modification, before the process illustrated in FIG. 6 starts, the power supply controller 501 stores Tup and Tsetup in the ROM. Tsetup is stored for each type of setup process. In step S6, the power supply controller 501 determines whether or not Tsetup(n) included in Tgap(n) is longer than or equal to Tup. The power supply controller 501 reads Tsetup and Tup corresponding to the type of setup process, and compares the length of Tsetup and Tup.

Figure 9:
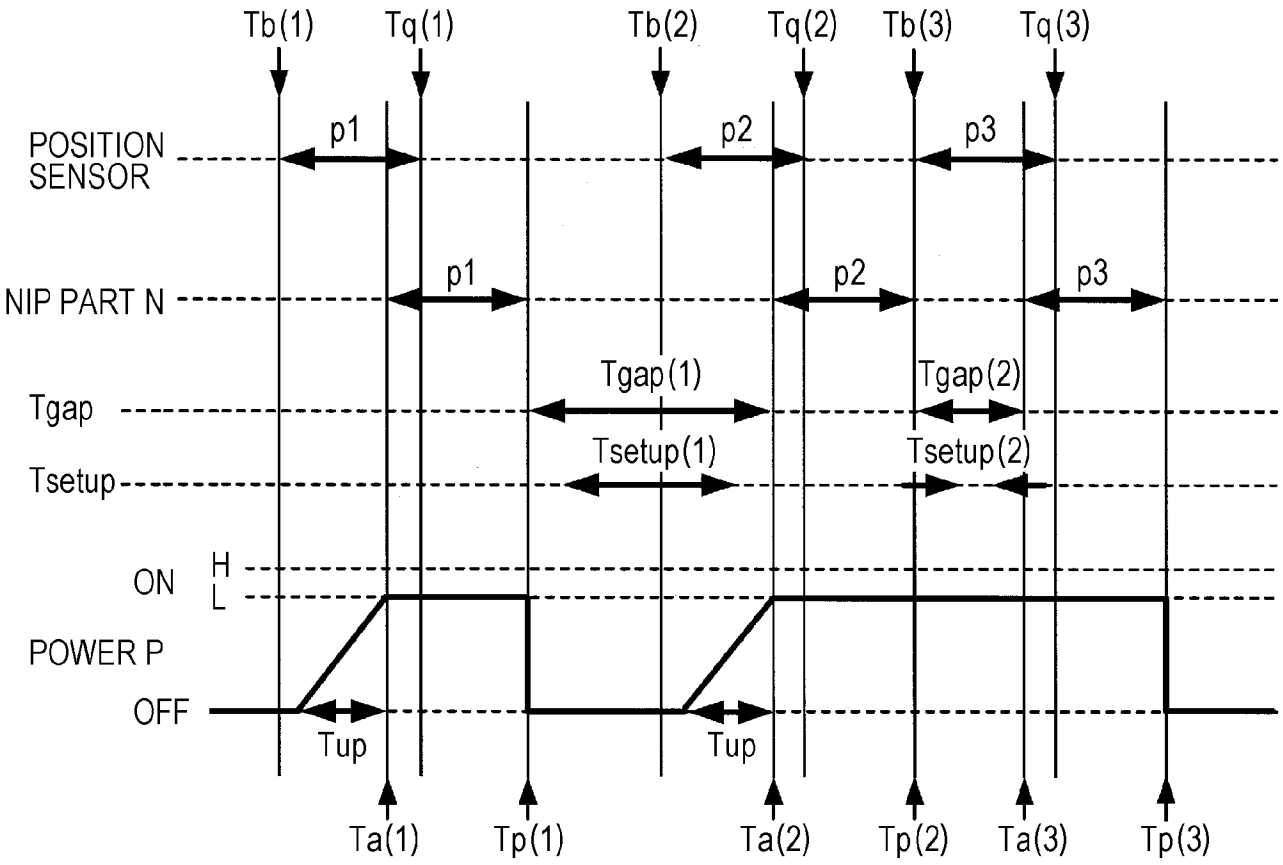
FIG. 9 is a timing chart of a fixing process according to a second modification.

FIG. 9 is a timing chart of a fixing process according to the second modification. In FIG. 9, the fixing process is performed on each of three sheets of paper p (p1, p2, p3) (which are plain paper). The setup process is performed during the time period between the passage time Tp(1) and the arrival time Ta(2) and during the time period between the passage time Tp(2) and the arrival time Ta(3). That is, the arrival time Ta(2) is delayed by Tsetup(1), and the arrival time Ta(3) is delayed by Tsetup(2). While the setup process may not necessarily be performed by the fixing section 50, in FIG. 9, Tsetup is also indicated by an arrow, for convenience of illustration.

In the first fixing process, Tsetup(1)≥Tup (YES in step S6). Thus, the power supply controller 501 controls the power supply 500 to turn off the supply of power at the passage time Tp(1). In the second fixing process, Tsetup(2)<Tup (NO in step S6). Thus, the power supply controller 501 continues the supply of power in the mode L even after the passage time Tp(2) has elapsed. Accordingly, if Tsetup is longer than or equal to Tup, the supply of power from the power supply 500 is temporarily turned off. Thus, the amount of power consumed by the fixing section 50 may be reduced, compared to when the supply of power continues during the setup process.

In another example, Tsetup may be included in Tgap. In this case, the power supply controller 501 estimates the arrival time Ta and the passage time Tp while taking Tsetup into account.

Third Modification

If Tgap<Tup+Tdown (NO in step S6) and if the supply of power is continued during Tgap, the magnitude of the power to be supplied may not necessarily satisfy the magnitude of the power necessary to fix the toner onto each sheet of paper p. That is, if Tgap<Tup+Tdown, the magnitude of the power to be supplied during Tgap may be smaller than that when each sheet of paper p passes the nip part N (hereinafter referred to as the "toner fixing time"). In this case, the power supply controller 501 temporarily reduces the power to be supplied during Tgap(n), and returns the power mode to the mode L or the mode H by the arrival time Ta(n+1). A description will be given of an example in which the supply of power is reduced when Tgap<Tup+Tdown (NO in step S6). In the following description, by way of example, Tup and Tdown are equal to each other.

Figure 10A:
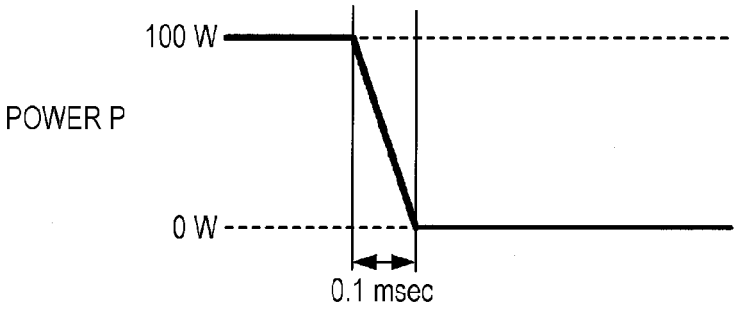
FIGS. 10A to 10D illustrate a process for reducing the supply of power according to a third modification.

FIGS. 10A to 10D illustrate a process for reducing the supply of power according to a third modification. FIG. 10A illustrates a state where the supply of power is turned off. In the illustrated example, the power necessary to fix the toner onto each sheet of paper p is 100 W, and a time period required for the supply of power to be turned off (i.e., 0 W) after 100 W is set is 0.1 msec. Thus, a time period required for the power supply 500 to switch the supply of power from 100 W to the off state and again from the off state to 100 W is 0.2 msec.

Figure 10B:
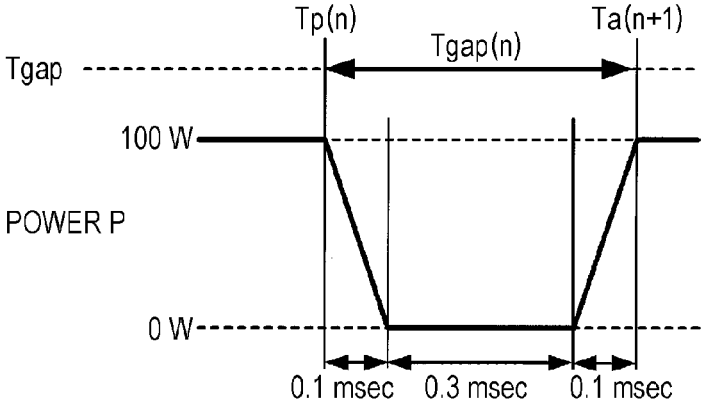

FIG. 10B illustrates a comparative example in which Tgap≥Tup+Tdown. In FIG. 10B, Tgap is 0.5 msec, and is longer than Tup+Tdown by 0.2 msec or more (YES in step S6).

Figure 10C:
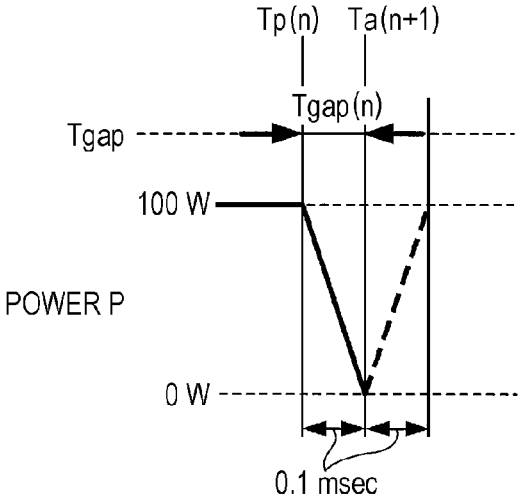
Figure 10D:
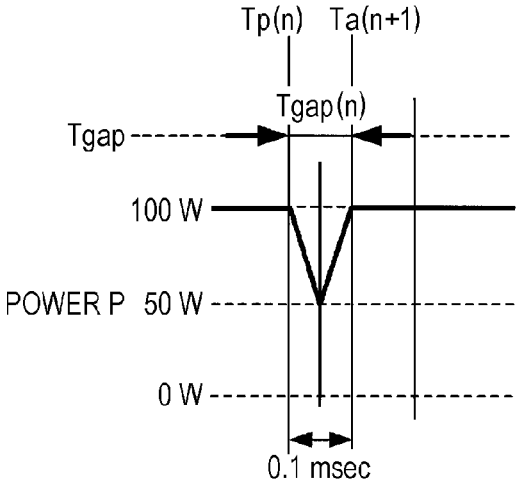

In this case, the supply of power is turned off at the passage time Tp(n), and the supply of power is turned on at the arrival time Ta(n+1). A time period during which the supply of power is turned off is 0.3 msec. FIGS. 10C and 10D illustrate the third modification in which Tgap<Tup+Tdown. In FIG. 10C, Tgap is 0.1 msec, and is shorter than Tup+Tdown by 0.2 msec (NO in step S6). Thus, if the power supply controller 501 turns on the supply of power after turning off the supply of power during Tgap, it is difficult to turn on the supply of power at the arrival time Ta(n+1). In the third modification, as illustrated in FIG. 10D, the power supply controller 501 temporarily reduces the power to be supplied from 100 W to 50 W during Tgap(n), and returns the power to 100 W by the arrival time Ta(n+1). The value of the power to be supplied during Tgap(n) is calculated by the power supply controller 501 in accordance with the length of Tgap and the speed Vc at which the power supply 500 changes the magnitude of the power.

Referring back to FIG. 10A, as may be seen from the power supply gradient, the power supply 500 changes the magnitude of the power to be supplied at a speed of 1 kW per millisecond. The power supply controller 501 calculates the value Pg of the power to be supplied during Tgap(n) using, for example, the following formula (2):

$$Pg=Pf-(v_c\times\tfrac{1}{2}Tgap) \quad (2)$$

(Pf: power necessary to fix toner)

Figure 11:
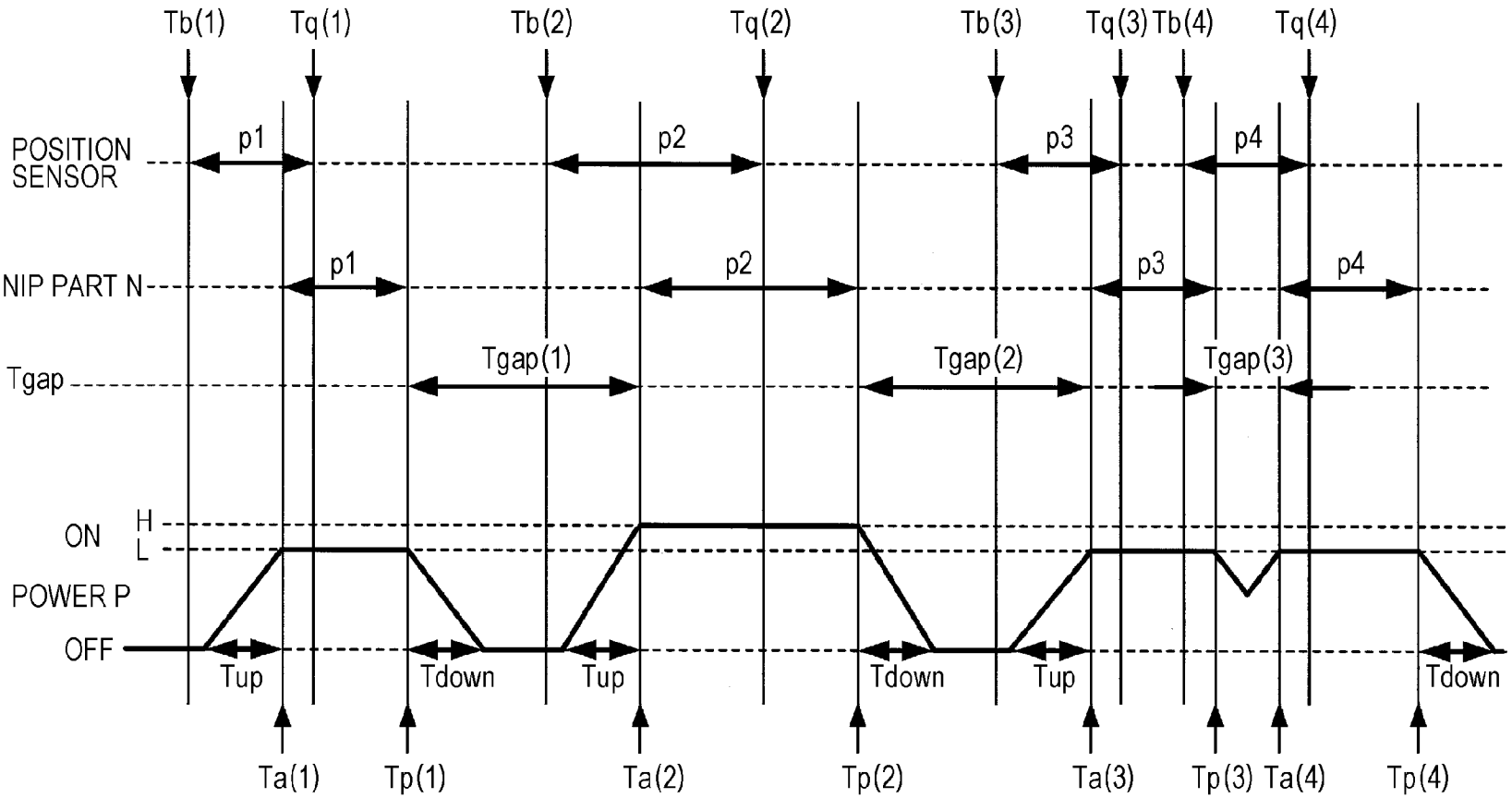
FIG. 11 is a timing chart of a fixing process according to the third modification.

FIG. 11 is a timing chart of a fixing process according to the third modification. In the foregoing exemplary embodiment, the magnitude of the power to be supplied during Tgap(3) is equal to the magnitude of the power to be supplied during the toner fixing time. As illustrated in FIG. 11, in the third modification, the magnitude of the power to be supplied during Tgap(3) is smaller than the magnitude of the power to be supplied during the toner fixing time. Accordingly, even if Tgap<Tup+Tdown, the amount of power consumed by the fixing section 50 may be reduced, compared to when the power to be supplied is kept constant between Tgap and the toner fixing time.

Fourth Modification

The foregoing exemplary embodiment is based on the ideal state where the thermal capacity of the fixing belt 51 is zero and where the warm-up time is zero. The thermal capacity of the fixing belt 51 may not necessarily be zero, and the temperature of the fixing belt 51 may not necessarily reach the fixing temperature at the same time as the supply of power. In this case, the power supply controller 501 may control the supply of power while taking into account the delay time required until the fixing belt 51 reaches the fixing temperature after the supply of power is turned on. For example, the power supply controller 501 may perform control to start the operation of turning on the supply of power at a time which is a delay time period prior to the timing at which the operation of turning on the supply of power is started in the foregoing exemplary embodiment.

Fifth Modification

In the fixing process, it may be determined whether or not to temporarily turn off the supply of power from the power supply 500 during Tgap, by taking into account the internal temperature of the housing 100*a*. The temperature of the fixing belt 51 changes at a rate corresponding to that of the internal temperature of the housing 100*a*. Even if power is supplied during the same time period, the higher the internal temperature of the housing 100*a*, the higher the speed at which the temperature of the fixing belt 51 increases; the lower the internal temperature of the housing 100*a*, the lower the speed at which the temperature of the fixing belt 51 increases. Thus, if the internal temperature of the housing 100*a* is lower than a predetermined temperature (e.g., 10° C.), the supply of power may be continued during Tgap(n) regardless of whether or not Tgap(n) is longer than or equal to Tup. In this case, the internal temperature of the housing 100*a* is measured using a temperature sensor. The temperature sensor may be provided near, for example, the rotating roller 407.

Figure 12A:
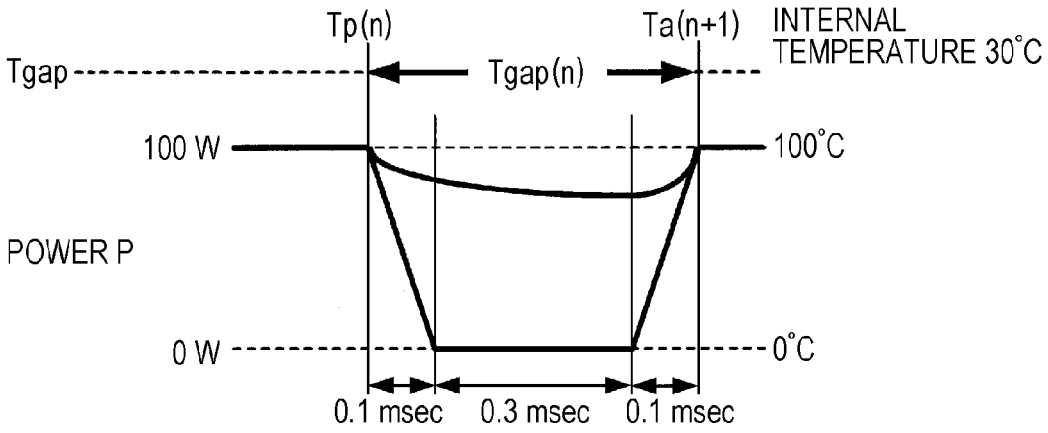
FIGS. 12A to 12C illustrate the supply of power according to a fifth modification.
Figure 12B:
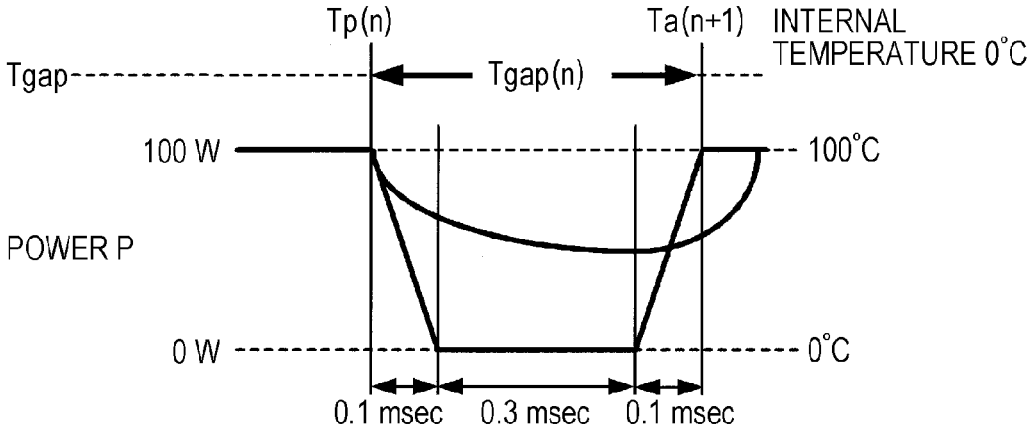
Figure 12C:
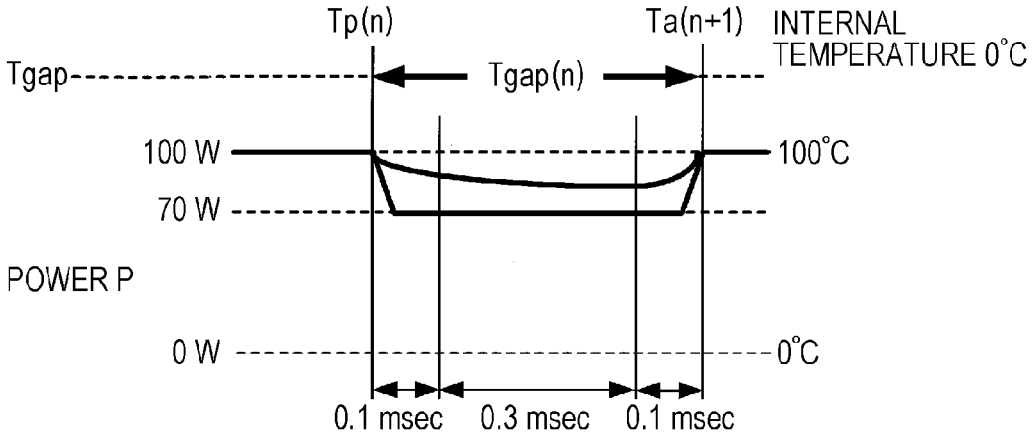

FIGS. 12A to 12C illustrate the supply of power according to a fifth modification. In FIGS. 12A to 12C, by way of example, the fixing temperature is 100° C. In FIGS. 12A to 12C, a curve indicates a change in the temperature of the fixing belt 51. In FIG. 12A, the internal temperature of the housing 100*a* is 30° C., and is higher than the predetermined temperature. When the operation of turning off the supply of power from the power supply 500 is started at the beginning of Tgap(n), the temperature of the fixing belt 51 also decreases from 100° C. When the operation of turning on the supply of power from the power supply 500 is started again at a time which is 0.4 msec after the beginning of Tgap, the temperature of the fixing belt 51 increases again. The temperature of the fixing belt 51 returns to 100° C. again at the arrival time Ta(n+1). Accordingly, if the internal temperature of the housing 100*a* is larger than the predetermined temperature, even if the supply of power is temporarily turned off during Tgap(n), the temperature of the fixing belt 51 returns to 100° C. again by the arrival time Ta(n+1). In FIG. 12B, the internal temperature of the housing 100*a* is 0° C., and is lower than the predetermined temperature. When the operation of turning off the supply of power from the power supply 500 is started at the beginning of Tgap(n), the speed at which the temperature of the fixing belt 51 decreases is higher than that when the internal temperature is 30° C. as illustrated in FIG. 12A. In addition, when the operation of turning on the supply of power from the power supply 500 is started again, the speed at which the temperature of the fixing belt 51 increases is lower than that when the internal temperature is 30° C. as illustrated in FIG. 12A. As illustrated in FIG. 12B, if the internal temperature of the housing 100*a* is lower than the predetermined temperature, when the supply of power is temporarily turned off during Tgap(n), the temperature of the fixing belt 51 does not return to 100° C. again by the arrival time Ta(n+1). Accordingly, if the internal temperature of the housing 100*a* is lower than the predetermined temperature, as illustrated in FIG. 12C, the power supply controller 501 may continue the supply of power. In this case, the power supply controller 501 may make the magnitude of the power to be supplied during Tgap smaller than that during the toner fixing time. In FIG. 12C, the power supply controller 501 temporarily reduces the power to be supplied from 100 W to 70 W during Tgap(n), and returns the power to be supplied to 100 W by the arrival time Ta(n+1). The magnitude of the power to be supplied during Tgap(n) is adjusted so that the temperature of the fixing belt 51 reaches the fixing temperature by the arrival time Ta(n+1), in accordance with the internal temperature of the housing 100*a* and the speed Vc at which the power supply 500 changes the magnitude of the power.

Sixth Modification

The time period during which the power supply controller 501 temporarily turns off the supply of power is not limited to Tgap. The power supply controller 501 may temporarily turn off the supply of power during, for example, a time period between image areas where toner images have been transferred. In this case, the power supply controller 501 acquires, as the arrival time Ta, a time at which an image area in a sheet of paper p arrives at the nip part N and further acquires, as the passage time Tp, a time at which an image area in the sheet of paper p passes the nip part N. The power supply controller 501 calculates, as Tgap(n), a time period from the time Tp(n) at which a certain image area among image areas on a sheet of paper p passes the nip part N to the time Ta(n+1) at which the subsequent image area arrives at the nip part N. Each sheet of paper p may have plural image areas, and the supply of power may be temporarily turned off during a time period between image areas.

Seventh Modification

The timing at which the power supply 500 starts the operation of turning off the supply of power may not necessarily be the same as the passage time Tp. The power supply 500 may start the operation of turning off the supply of power at any time during Tgap. In addition, the timing at which the supply of power is turned on may not necessarily be the same as the arrival time Ta. The power supply 500 may start the operation of turning on the supply of power at any time during Tgap if the supply of power is turned on by the arrival time Ta.

Eighth Modification

The length of Tgap may differ depending on factors other than the paper type. The length of Tgap may differ depending on, for example, the rotational speed of the transport rollers 30. In another example, the paper types are not limited to plain paper and thick paper. Other examples of the paper types may include thin paper (55 g/m$^2$ or more and less than 64 g/m$^2$). In this case, the length of Tgap when the n-th sheet of paper p or the (n+1)-th sheet of paper p is thin paper is shorter than the length of Tgap when the n-th sheet of paper p or the (n+1)-th sheet of paper p is plain paper. In still another example, the paper types are not limited to those distinguished by weight.

Ninth Modification

The mode L and the mode H are examples representing the magnitude of the power to be supplied, and other power modes may be used. In addition, Tup and Tdown may differ depending on the power mode.

Tenth Modification

The present invention may also be implemented as a program for causing a computer in the image forming apparatus 1 or the fixing device described above (i.e., the fixing section 50) to execute the process illustrated in FIG. 6. This program may be stored and provided on a computer-readable recording medium such as a magnetic recording medium (e.g., a magnetic tape or a magnetic disc (an HDD, a flexible disk (FD))), an optical recording medium (e.g., an optical disc (a compact disk (CD) or a digital versatile disk (DVD))), a magneto-optical recording medium, or a semiconductor memory (e.g., a flash ROM). The program may also be downloaded via a network such as the Internet.

Eleventh Modification

The fixing unit is not limited to the fixing belt 51. The fixing unit may have, for example, a heat accumulation plate that is heated through electromagnetic induction to implement high productivity. The heat accumulation plate is a member formed of a temperature-sensitive magnetic alloy and disposed in contact with the fixing belt 51 along the inner circumferential surface of the fixing belt 51. The thickness and material of the heat accumulation plate are adjusted so that heat is generated through electromagnetic induction in the alternating magnetic field generated by the IH heater 53. The heat generated from the heat accumulation plate is supplied to the fixing belt 51. In this manner, a fixing device including a heat accumulation plate allows the fixing belt 51 to be warmed by the heat generated from the heat accumulation plate as well as the heat generated from the fixing belt 51. Thus, such a fixing device may prevent the reduction in the temperature of the fixing belt 51 while increasing the efficiency of electromagnetic induction heating by the IH heater 53, thereby yielding high productivity.

In another example, the fixing unit may not necessarily have a belt shape but may have a roll shape.

In still another example, the fixing belt 51 may have a single-layer configuration having a single material. For example, the fixing belt 51 may have a single layer formed of a metal, such as Ni, having a thickness of approximately 50 μm.

Twelfth Modification

In the foregoing exemplary embodiment, the power supply controller 501 estimates the arrival time Ta and the passage time Tp in accordance with a time acquired from the position sensor and the rotational speed of the transport roller 30*a* at the acquired time. The arrival time Ta and the passage time Tp may not necessarily be estimated in accordance with information obtained by the position sensor. For example, if the productivity with which the image forming apparatus 1 ejects sheets of paper p onto which toner images have been fixed is determined in advance, and Tgap is determined in advance, the power supply controller 501 may estimate the arrival time Ta and the passage time Tp based on the productivity of the image forming apparatus 1.

Other Modifications

The configuration for inductively heating the conductive heat generating layer 512 is not limited to that illustrated in FIG. 5. For example, some of or all the functions of the power supply controller 501 may be performed by the controller of the image forming apparatus 1. The fixing belt 51 may have a single-layer configuration having a single material. For example, the fixing belt 51 may have a single layer formed of a metal, such as Ni, having a thickness of approximately 50 μm.

Some of or all the processes performed by the power supply controller 501 may be performed by the controller of the image forming apparatus 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit that fixes toner onto a recording medium transported in a determined transport direction, using heat generated by a heat generator;

a power supply unit that supplies power to drive the fixing unit;

a pressure applying unit that applies pressure to the recording medium in a nip part formed between the pressure applying unit and the fixing unit; and a controller that controls the power supply unit to supply power during a transport time period between subsequent recording media, in accordance with a relationship between a first time period and a second time period, when a plurality of recording media are sequentially transported, the first time period being an estimated gap time period from when a trailing edge of one of the recording media in the transport direction will pass the nip part to when a leading edge of a recording medium subsequent to the one of the recording media in the transport direction will arrive at the nip part, the second time period being a pre-stored warm-up time period required for the power supply unit to change the power from a power off state to a state in which a magnitude of the power exceeds a threshold magnitude at which the toner is fixed onto the recording medium.

2. The fixing device according to claim 1, wherein if the first time period is longer than or equal to the second time period, the controller causes the supply of power to be stopped during the transport time period.

3. The fixing device according to claim 2, further comprising a housing, wherein the fixing unit, the power supply unit, the pressure applying unit, the controller, and the heat generator are provided in the housing, and wherein the controller causes the supply of power to be stopped during the transport time period when an internal temperature of the housing is higher than a determined temperature.

4. The fixing device according to claim 1, wherein if the first time period is shorter than the second time period, the controller causes the supply of power to be continued during the transport time period.

5. The fixing device according to claim 4, wherein the controller causes the supply of power to be continued during the transport time period, by controlling the power supply unit to supply power so that the power to be supplied is lower than power used to fix the toner onto each of the recording media.

6. The fixing device according to claim 1, further comprising a magnetic field generation unit that generates an alternating magnetic field for causing the heat generator to generate heat through electromagnetic induction, wherein the power supply unit supplies power to the magnetic field generation unit.

7. An image forming apparatus comprising:

a transfer unit that transfers a toner image onto a recording medium; and the fixing device according to claim 1, the fixing device fixing toner onto the recording medium onto which the toner image has been transferred by the transfer unit.

8. The fixing device according to claim 1, wherein the threshold magnitude is set based on a paper type of the recording medium.

9. A fixing device comprising:

a fixing unit that fixes toner onto a recording medium transported in a determined transport direction, using heat generated by a heat generator;

a power supply unit that supplies power to drive the fixing unit;

a pressure applying unit that applies pressure to the recording medium in a nip part formed between the pressure applying unit and the fixing unit; and a controller that controls the power supply unit to supply power during a transport time period between subsequent recording media, in accordance with a relationship between a first time period and a second time period, when a plurality of recording media are sequentially transported, the first time period being a pre-stored time period required to perform an external process other than a process of fixing the toner, the second time period being a pre-stored warm-up time period required for the power supply unit to change the power from a power off state to a state in which a magnitude of the power exceeds a threshold magnitude at which the toner is fixed onto the recording medium.

10. The fixing device according to claim 9, wherein if the first time period is longer than or equal to the second time period, the controller causes the supply of power to be stopped during the transport time period.

11. The fixing device according to claim 10, further comprising a housing, wherein the fixing unit, the power supply unit, the pressure applying unit, the controller, and the heat generator are provided in the housing, and wherein the controller causes the supply of power to be stopped during the transport time period when an internal temperature of the housing is higher than a determined temperature.

12. The fixing device according to claim 9, wherein if the first time period is shorter than the second time period, the controller causes the supply of power to be continued during the transport time period.

13. The fixing device according to claim 12, wherein the controller causes the supply of power to be continued during the transport time period, by controlling the power supply unit to supply power so that the power to be supplied is lower than power used to fix the toner onto each of the recording media.

14. The fixing device according to claim 9, further comprising a magnetic field generation unit that generates an alternating magnetic field for causing the heat generator to generate heat through electromagnetic induction, wherein the power supply unit supplies power to the magnetic field generation unit.

15. An image forming apparatus comprising:

a transfer unit that transfers a toner image onto a recording medium; and the fixing device according to claim 9, the fixing device fixing toner onto the recording medium onto which the toner image has been transferred by the transfer unit.

16. The fixing device according to claim 9, wherein the threshold magnitude is set based on a paper type of the recording medium.

17. A non-transitory computer readable medium storing a program causing a computer to execute a process, the process comprising:

fixing toner onto a recording medium transported in a determined transport direction, using heat generated by a heat generator;

supplying power to fix the toner onto the recording medium;

applying pressure to the recording medium in a nip part; and controlling supply of power during a transport time period between subsequent recording media, in accordance with a relationship between a first time period and a second time period, when a plurality of recording media are sequentially transported, the first time period being an estimated gap time period from when a trailing edge of one of the recording media in the transport direction will pass the nip part to when a leading edge of a recording medium subsequent to the one of the recording media in the transport direction will arrive at the nip part, the second time period being a pre-stored warm-up time period required for the supply of power to be changed from a power off state to a state in which a magnitude of the power exceeds a threshold magnitude at which toner is fixed onto the recording medium.

18. The computer readable medium according to claim 17, wherein the threshold magnitude is set based on a paper type of the recording medium.

* * * * *